US005225615A

United States Patent [19]

Talbot et al.

[11] Patent Number: 5,225,615

[45] Date of Patent: Jul. 6, 1993

[54] COMPENSATED BARREL SHROUD

[75] Inventors: Robert Talbot, Holland; Edward C. Arventos, Monson, both of Mass.

[73] Assignee: Wesson Firearms Co., Inc., Palmer, Mass.

[21] Appl. No.: 826,622

[22] Filed: Jan. 28, 1992

[51] Int. Cl.[5] ..... F41A 21/34; F41A 21/36; F41C 27/04

[52] U.S. Cl. ..... 89/14.3; 42/79

[58] Field of Search ..... 89/14.2, 14.3, 14.4, 89/14.05; 42/79

[56] References Cited

U.S. PATENT DOCUMENTS

| | | | |
|---|---|---|---|
| 1,339,614 | 5/1920 | Woken | 89/14.2 |
| 2,796,005 | 6/1957 | Shapel | 89/14.3 |
| 2,899,866 | 8/1959 | Clark et al. | 89/14.3 |
| 2,935,000 | 5/1960 | Mowrey | 89/14.3 |
| 4,058,050 | 11/1977 | Brouthers | 89/14.3 |
| 4,304,061 | 12/1981 | Brouthers | 42/77 |
| 4,691,614 | 9/1987 | Leffel et al. | 89/14.3 |
| 4,833,810 | 5/1989 | Domian | 42/100 |

*Primary Examiner*—David H. Brown
*Attorney, Agent, or Firm*—Wolf, Greenfield & Sacks

[57] ABSTRACT

A compensated barrel shroud that encloses and supports a firearm barrel provides a first portion of the shroud for receiving the barrel that extends from the firearm frame to an end of the barrel. There is a second larger diameter portion extending from the end of the barrel to a forwardmost outer end of the shroud. A securing nut engages threads at the end of the barrel and secures the barrel shroud to the barrel. An end cap is positioned at the forwardmost end of the shroud. The end cap has an outer hole with an inner diameter substantially equal to an inner of the barrel thereby forming an expansion chamber within the second portion. A plurality of slots are formed along a top surface of the second portion to allow expanding propellant gas from within the second portion to escape out of the slots. These slots are sized and arranged to provide a downward thrust to the barrel shroud to compensate recoil forces generated in firing a round.

26 Claims, 3 Drawing Sheets

C
22
44
38
54
60
59
20
30
84
82
64
62
66
79
78
F2
72
70
68
69
F1

36
44
34
42
38
56
54
58
60
59
62
32
30
84
82
64
F1
66
48
40
46
52
3
74
80
78
79
50
F3
F2
72
70
68
69
76

COMPENSATED BARREL SHROUD

FIELD OF THE INVENTION

This invention relates to a recoil compensated barrel shroud particularly for use in revolvers.

BACKGROUND OF THE INVENTION

Muzzle brakes and recoil compensators have been used for many years in order to improve the accuracy and reduce the felt recoil of various types of firearms. Large caliber firearms, particularly handguns, experience substantial muzzle climb due to recoil during firing.

This recoil results from the fact that the barrel and chamber of the firearm are usually located at a point above the handgrip. As such, the firearm's pivot point is positioned substantially below the chamber from which the bullet is propelled. The impulse generated by the exiting bullet results in an equal and opposite impulse transmitted through the barrel back toward the shooter. Since the impulse is directed along a line above the handgrip, a moment about the grip pivot point is created. Hence, the firearm has a tendency to rotate about the pivot point, causing the muzzle to rise as the bullet is fired.

These reactive forces are illustrated generally in FIG. 1 for a firearm 20, which in this embodiment is a revolver 20. F1 is the reactive force generated by the firing of a round and F2 is the resultant muzzle climb force as a moment about the pivot point C in the grip 22 is generated in the firearm 20.

Muzzle climb is particularly pronounced in handguns, since one or both of the user's hands generally rest upon the single grip below the line of the chamber and barrel. Thus, unlike rifles wherein a second hand positioned further outboard upon the barrel helps to stabilize the climb, both hands in a handgun are concentrated at the pivot point. Absent significant hand strength, maintaining the muzzle of a high powered handgun in a straight line proves very difficult especially during rapid fire.

Muzzle brakes and compensators are designed, generally, to port part of the propulsion gases generated by the cartridge into a direction opposite that of the muzzle climb. As such, the gases act as a "retro rocket" to simultaneously propel the muzzle downwardly as the recoil forces it to climb upwardly. Compensator port size and direction allows the downward propulsive force of the muzzle brake to be relatively equalized to the impulse generated climbing force.

A disadvantage of many handguns, particularly revolvers, however, is that their barrels tend to be short and tend to include various strengthening structures (such as lugs and ribs) along their tops and bottoms. Hence, the attachment of a conventional muzzle brake to the end of the barrel proves difficult due to the absence of a smooth continuous attachment surface such as a threaded end. Additionally, conventional attachable muzzle brakes and compensators tend to distort the lines of the barrel resulting in a more awkward appearance and an increased probability that the barrel end will snag upon brush, holsters and the like.

One form of barrel structure, particularly for use with revolvers involves the use of an interchangeable cylindrical barrel surrounded by a removable shroud. FIG. 6 depicts a threaded barrel 24, barrel shroud 26 and shroud securing nut 28 assembly according to the prior art. The use of a barrel shroud 26 according to the prior art, provides a possible structure for forming an integral recoil compensator without the disadvantages described above.

SUMMARY OF THE INVENTION

It is therefore an object of the present invention to provide a recoil compensator, particularly for use with handguns, that does not distort the firearm's profile or shape.

It is yet another object of this invention to provide a recoil compensator that substantially reduces muzzle climb while not significantly adding to firearm weight or complexity.

A compensated barrel shroud according to this invention for use with a firearm, adapted to accept a shrouded barrel, provides a shroud having a first portion and a second portion. The first portion extends from the frame to the end of the barrel. The second portion extends beyond the end of the barrel to the forwardmost end of the shroud. The second portion has an inner diameter that is substantially greater than that of the barrel. The forwardmost end of the shroud includes an end cap having an outlet hole with an inner diameter approximately equal to that of the groove or inner diameter of the barrel. As such, an expansion chamber is created in the second portion. Expanding gases are vented through a plurality of slots to cut through the top of the second portion of the shroud. These slots are, generally, transverse to an axis of the barrel and can be directed either slightly rearwardly or slightly forwardly. The vented gas serves to create a downward thrust to counteract recoil generated muzzle climb. The shroud is secured to the barrel and firearm frame by means of a securing nut that engages threads at a forward end of the barrel and bears upon a shoulder at a joint between the first and second portions of the shroud. The outer cross-sectional profile of the shroud is essentially equal along its entire length between the first and second portions resulting in a smooth outward appearance. The shroud may include standard lower lugs and upper ribs. The front sight may be positioned rearward of the slots for improved mounting.

BRIEF DESCRIPTION OF THE DRAWINGS

The foregoing objects and advantages will become more clear with reference to the following detailed description of the preferred embodiment and brief description of the drawings in which:

FIG. 2(*a*) is a partial cross-sectional side view of the expansion chamber of the compensated barrel shroud assembly of FIG. 1 according to an alternative embodiment;

DETAILED DESCRIPTION OF THE PREFERRED EMBODIMENT

Figure 1:
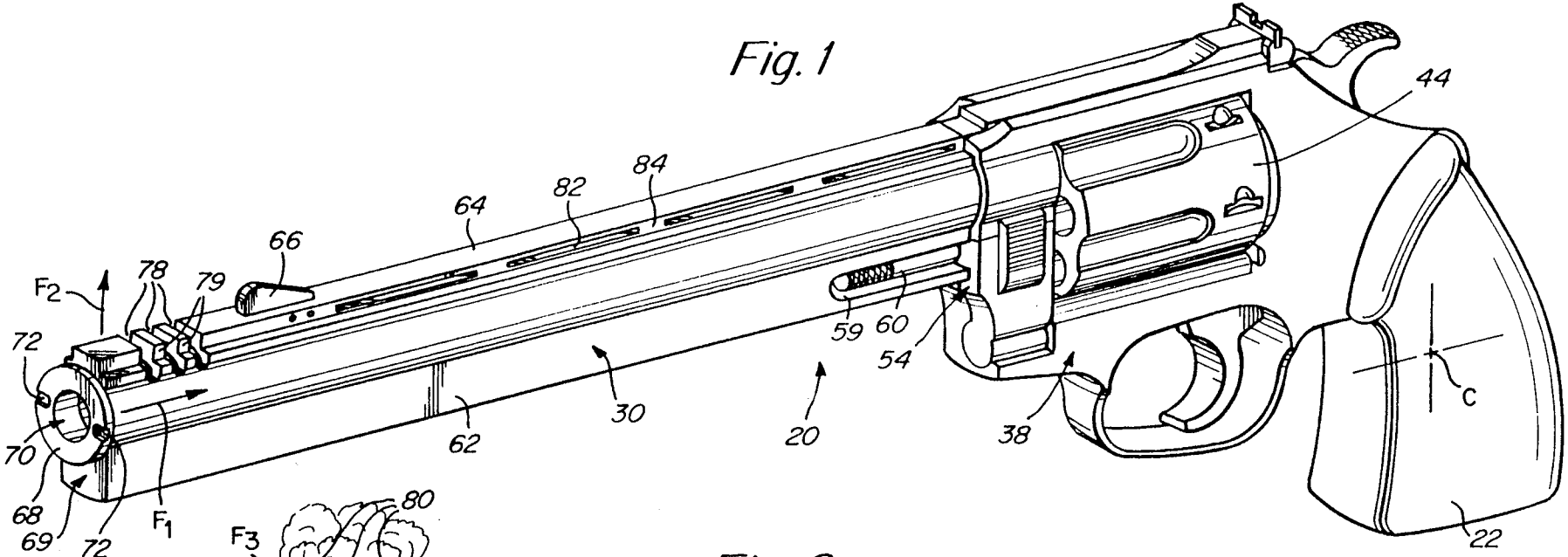
FIG. 1 is a perspective view of a firearm having a compensated barrel shroud according to this invention.

A firearm having a compensated barrel shroud according to this invention is depicted in FIG. 1. The firearm 20 depicted is, in particular, a large frame revolver of large caliber, such as 0.44 magnum caliber. The shroud 30 is further detailed in FIGS. 2–5 and the following discussion will be made with reference to each of these figures.

The barrel shroud assembly according to this invention is constructed in multiple parts. These parts include an internal rifled barrel 32 having rear threads 34 that allow the rear end 36 of the barrel to seat into corresponding threads in the frame 38. Note, as used herein front or forward shall mean toward the exit end 40 of the barrel 32 and rear or rearward shall mean toward the frame 38. The barrel 32 may include a larger diameter shoulder 42 where it meets the frame in order to limit inward passage of the barrel's rear end 36 into the frame 38, thus providing appropriate space between the cylinder 44 and inner barrel face. The opposing forward end 40 of the barrel 32 is also threaded.

Figure 2:
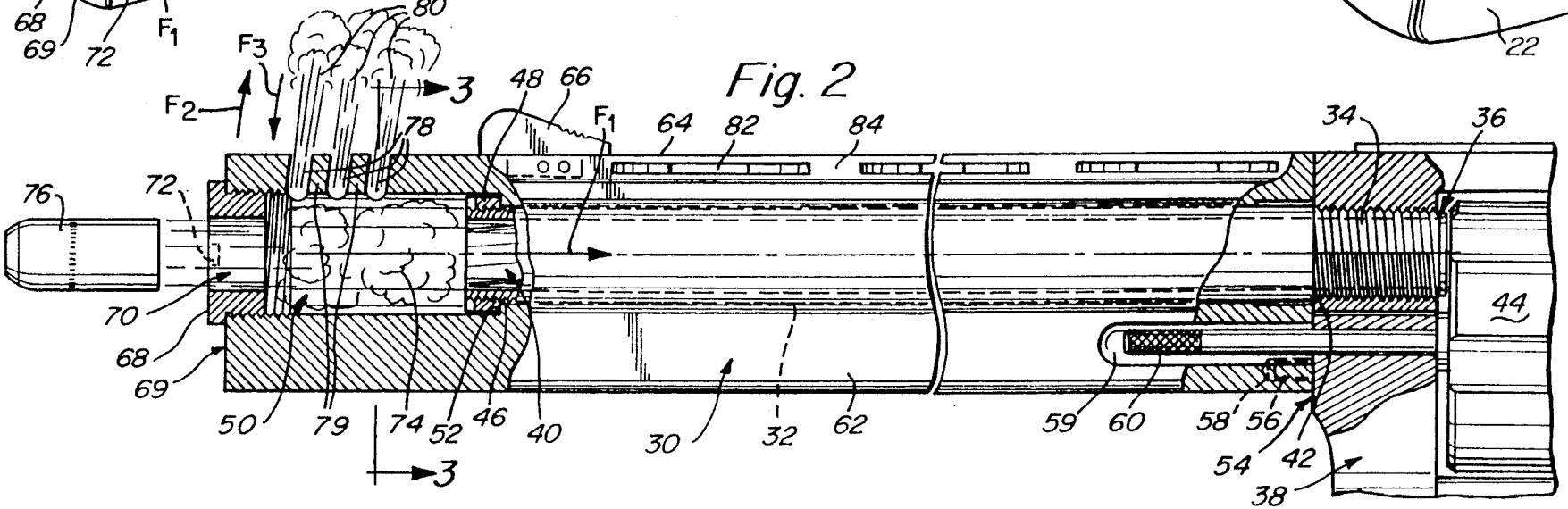
FIG. 2 is a cross-sectional side view of the compensated barrel shroud assembly of FIG. 1.
Figure 2A:
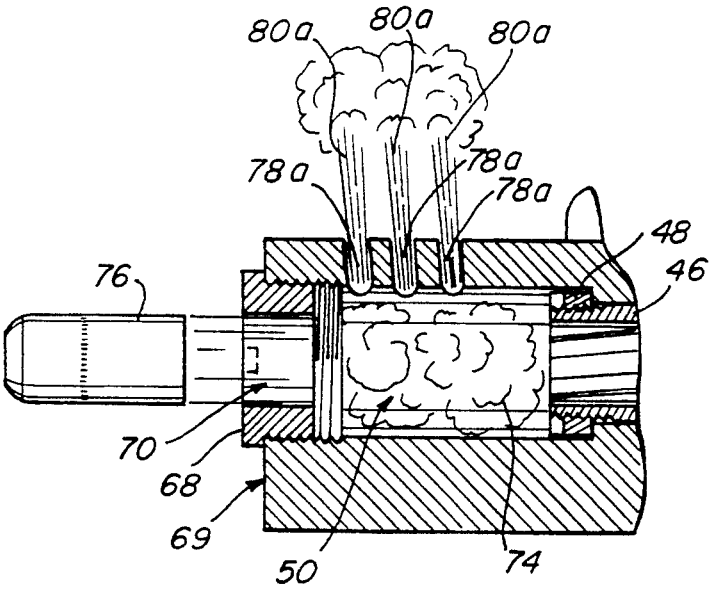
Figure 3:
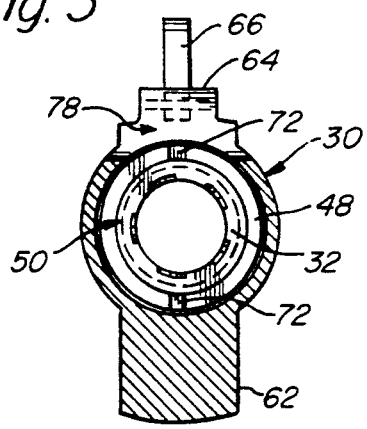
FIG. 3 is a cross-sectional front view of the compensated barrel shroud assembly taken along line 3—3 of FIG. 2.
Figure 4:
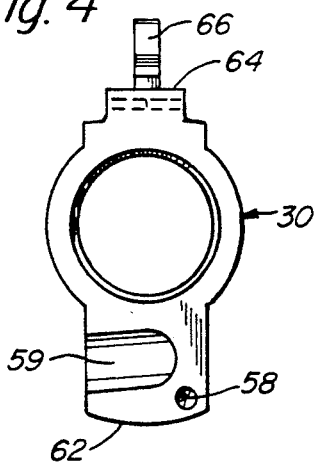
FIG. 4 is a rear view of the compensated barrel shroud assembly of FIG. 1.
Figure 5:
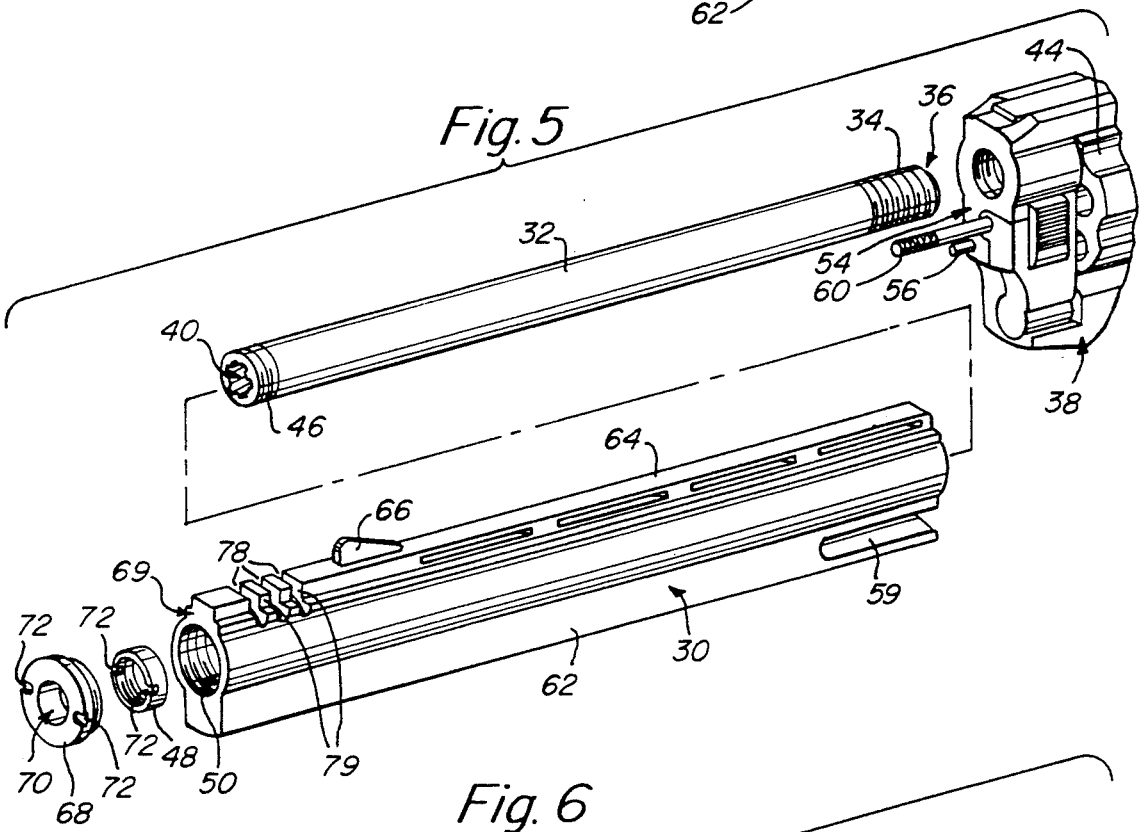
FIG. 5 is an exploded perspective view of the compensated barrel shroud assembly of the preferred embodiment.
Figure 6:
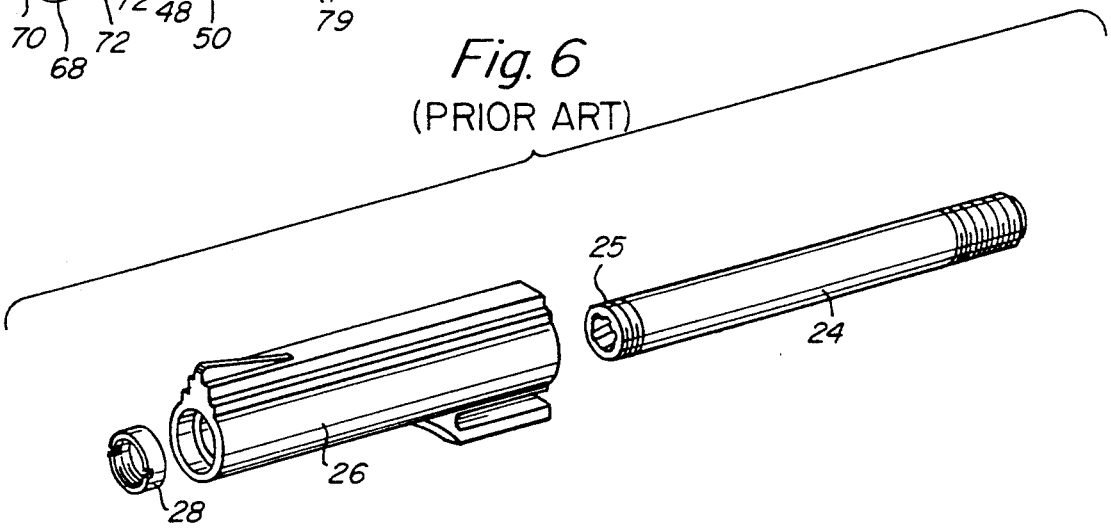
Fig. 6 (PRIOR ART)
FIG. 6 is an exploded perspective view of a barrel shroud assembly according to the prior art.

In a conventional shroud assembly as shown in FIG. 6, the forward barrel thread 25 would accommodate a shroud securing nut 28 that would seat into the barrel shroud end and maintain the barrel shroud 26 securely against the frame (not shown in FIG. 6, but illustrated as frame 38 in FIGS. 1–5). In this embodiment, however, the barrel 32 is substantially shorter than the overall length of the barrel shroud 30. The barrel shroud 30, itself, includes an enlarged chamber 50 having a length of approximately 1.75 inches and an inner diameter of 0.8 inch that is suitable for allowing passage therethrough of the shroud securing nut 48. The securing nut 48 is recessed in the chamber and specifically seats upon an inner shoulder 52 of the chamber 50 that is engaged when the nut 48 is suitably tightened onto the forward barrel end threads 46. The barrel 32 must already have been screwed firmly onto the frame 38 prior to mounting the shroud 30. In this manner, the shroud 30 is firmly maintained against the frame front face 54. Note that a guide pin 56 is included on the front face of the frame (FIGS. 2 and 5). This pin meets a corresponding hole 58 in the rear face of the barrel shroud (FIG. 4) in order to maintain a predetermined rotational alignment between the frame 38 and the shroud 30. The barrel shroud 30 also includes a suitable recess 59 for accommodating the cylinder cartridge ejector rod 60. This recess 59 is formed as part of the integral and continuous lower lug 62 that extends the entire length of the shroud 30. The lug 62 provides further reinforcement and weighting to the barrel assembly.

The barrel shroud 30 according to this invention also includes an upper rib 64 for further strengthening and also to provide a suitable base for a front sight 66.

As noted above, unlike prior art designs, the barrel shroud 30 of this embodiment extends forwardly beyond the end 40 of the barrel 32. The overall cross sectional profile or shape of the shroud, however, remains constant along the entire length from front to rear. The forward chamber 50 formed in the barrel shroud 30 is capped at the shroud s forward end 69 by a narrower diameter end cap 68 having an exit orifice 70 sized substantially similarly (slightly larger) in inner diameter (approximately 0.45 inch) to the caliber of the bullet to be fired. Thus the cap 68 is substantially similar to the inner diameter of the barrel 32. This end cap 68 may be attached by a suitable spanner wrench (not shown) that may be inserted into the depicted indents 7 (also shown for the shroud securing nut 48). As shown in FIG. 2, the end cap 68 acts to reduce the inner diameter of the chamber 50 a its forwardmost outlet. The diameter of the barrel 32 entering the rear of the chamber 50 is also, as noted, significantly smaller. Hence, the chamber 50 acts as a gas expansion chamber, allowing cartridge propellent gases 74 to instantaneously expand as the bullet 76 passes from the forward end 40 of the barrel 32 into the chamber 50.

Since the end cap 68 is sized somewhat similarly in diameter to the bullet, as the bullet 76 passes through the end cap 68, it substantially seals the front outlet 70 of the chamber for a brief instant. As the front chamber outlet 70 is sealed, the expanding gases 74 in the chamber 50 are vented from the chamber 50 out of the three compensator slots 78 cut through the upper rib 64 of the shroud transverse to the barrel axis. As shown in FIG. 2, these slots 78 create three individual jets 80 of expanding gas that are momentarily vented upwardly and slightly rearwardly. The action of these jets 80 creates an equal and opposite reactive force F3 positioned substantially downwardly and slightly forwardly This force acts substantially along the same line (arc) as opposing muzzle climb force F2 thus, the vented gas 80 serves to reduce or "compensate" the muzzle climb force F2 resulting in reduced muzzle climb both during and after exit of the bullet 76 from the firearm 20.

As noted above, in this embodiment, three compensator slots 78 are utilized. For a 0.44 magnum round, each slot 78 should preferably be sized to approximately $\frac{1}{8}$ inch in width and have a rearward angle of approximately 7 degrees from a vertical line taken transversely to the barrel axis 80 (FIG. 2). This rearward slope aids in reducing rearward acting recoil by introducing a rearward thrust component. However, where the fouling of a mounted pistol scope with powder residue or backblast in the shooter's face may be a concern, the slots may be positioned vertically or even forwardly according to this invention. In one embodiment, a 4 degree forward slant (shown in FIG. 2(*a*)) in the slots 78(*a*) provides good muzzle climb compensation while also directing the gasses 80(*a*) away from the shooter and scope.

The slots 78 may be cut in a solid forged or, otherwise, machined shroud by standard machining processes. The slots 78 should be placed as far forwardly as possible on the shroud in order to generate maximum pressure of the expanding gases 74 in the chamber 50, and also to maximize leverage at pivot point C (FIG. 1) resulting from the generated downward force F3. The set of slots 78 of this embodiment are particularly located $\frac{3}{8}$ inch from the forward end 69 of the shroud 30 and approximately $\frac{1}{2}$ inch forwardly of the barrel end 40. The slots 78 in this embodiment are spaced by spacer sections 79 that are approximately 7/64 inch in length taken axially. Of course, for other barrel calibers used in smaller frame revolvers such as 0.357 magnum, variations in slot width and spacing may be desirable in order to generate a predetermined optimum compensation of muzzle climb. However, a single shroud with a particular slot configuration may be constructed to interchange with a variety of barrel calibers that use the same frame size such as 0.41, 0.45, 0.44 and 0.445.

Due to the presence of multiple compensator slots 78, a full sized leaf front sight may not fit proximate the forwardmost end 68 of the barrel shroud. Hence, the sight 66 of this embodiment is positioned just rearwardly of the expansion chamber 50 in this embodiment. In this position, the shroud top rib 64 is sufficiently thick to enable firm mounting of the sight 66 thereon. Note that the rib 64 also includes horizontal slots 82 and webs 84. The slots 82 help to reduce weight while the webs 84 provide a good location for drilling and tapping a scope mount.

Inasmuch as the recoil compensated barrel shroud 30 according to this invention utilizes similar sized barrels and mounting nuts as prior art standard uncompensated shrouds, it is also possible to simply interchange a compensated shroud according to this invention with such an uncompensated prior art shroud. In this manner, the owner of a shrouded firearm has the option of upgrading the unit to include a compensated barrel shroud according to this invention. The user may, similarly, remove the compensated shroud, and any attached scope, and replace it with a standard length uncompensated shroud as needed.

It should be understood that the preceding is merely a detailed description of a preferred embodiment. It should be apparent to those skilled in the art that various modifications and equivalents may be made without departing from the spirit or scope of the invention. The preceding description is meant, therefore, to be taken only by way of example and not to otherwise limit the scope of the invention.

What is claimed is:

1. A compensated barrel shroud that encloses and supports a firearm barrel therein comprising:

a first portion for receiving the barrel extending from a firearm frame to an end of the barrel, the barrel being threaded at the end;

a second portion extending from the end of the barrel to a free end of the shroud, the inner diameter of the second portion being larger than an inner diameter of the barrel;

a securing nut for engaging the threads at the barrel end for securing the barrel shroud to the barrel;

an end cap positioned at the free end of the shroud having an inner diameter substantially equal to the inner diameter of the barrel; and a plurality of slots formed along a top surface of the second portion to allow gas from within the second portion to escape out of the slots, the slots being sized and arranged to provide a downward thrust to the barrel shroud.

2. The compensated barrel shroud as set forth in claim 1 wherein a junction between the first portion and the second portion includes an inner shoulder that is sized for engagement by the securing nut.

3. A compensated barrel shroud as set forth in claim 1 wherein the second portion includes three slots each having a width, taken along an axial direction of the barrel, of approximately 150 inch.

4. A compensated barrel shroud as set forth in claim 3 wherein the inner diameter of the second portion is approximately 0.8 inch.

5. The compensated barrel shroud as set forth in claim 1 wherein the second portion includes three slots.

6. A compensated barrel shroud as set forth in claim 5 wherein each of the slots is angled to vent gas rearwardly toward the frame.

7. A compensated barrel shroud as set forth in claim 6 wherein the rearward angle is approximately 7 degrees from a vertical line taken transversely to an axis of the barrel.

8. A compensated barrel shroud as set forth in claim 5 wherein each of the slots is angled to vent gas forwardly away from the frame.

9. A compensated barrel shroud as set forth in claim 8 wherein the forward angle is approximately 4 degrees from a vertical line taken transversely to an axis of the barrel.

10. A compensated barrel shroud as set forth in claim 1 wherein the end cap includes threads for attachment to the free end of the barrel shroud.

11. A compensated barrel shroud as set forth in claim 10 wherein a forwardmost of the slots is positioned substantially adjacent the thread for the end cap.

12. A compensated barrel shroud as set forth in claim 11 wherein each of the first and second portions include a continuous substantially rectangular rib disposed along a top portion thereof.

13. A compensated barrel shroud as set forth in claim 12 wherein each of the first and second portions include a continuous substantially rectangular lug disposed along a bottom portion thereof.

14. A compensated barrel shroud as set forth in claim 13 wherein a front sight is positioned upon the first portion substantially proximate the second portion.

15. A compensated barrel shroud as set forth in claim 14 wherein each of the securing nut and shroud end cap include indents for attachment of a spanner wrench thereto.

16. A compensated barrel shroud as set forth in claim 15 wherein the inner diameter of the second portion is sized along its length to allow removal of the securing nut from the end of the shroud.

17. A firearm comprising:

a frame;

a barrel exiting the frame;

a shroud positioned over the barrel and secured thereto by securing means located at a forward end of the barrel;

the shroud including a first portion extending from the frame to the forward end of the barrel and a second portion extending forward of the forward end of the barrel, the second portion including an inner diameter that is greater than an inner diameter of the barrel, the second portion further including an end cap positioned at a forwardmost outer end of the shroud and having an outlet hole coaxial with the barrel and having a diameter substantially equal to the inner diameter of the barrel; and a plurality of slots positioned transversely to an axis of the barrel along a top surface of the second portion of the shroud so that expanding propellant gas may pass through each of the slots to provide downward thrust to the shroud.

18. A firearm as set forth in claim 17 wherein the inner diameter of the chamber is approximately 0.8 inch.

19. A firearm as set forth in claim 17 wherein the barrel is sized for calibers in a range of 0.4 to 0.5 inch.

20. A firearm as set forth in claim 17 wherein the second portion includes three slots thereon.

21. A firearm as set forth in claim 20 wherein a forwardmost of the slots is positioned upon the second portion at a position substantially adjacent a rearmost portion of the end cap so as to enable venting a gasses therefrom at as far forward a position as practical free of obstruction of the gasses by the end cap.

22. A firearm as set forth in claim 21 wherein each of the slots is angled rearwardly taken in a direction from the chamber to the top surface of the shroud.

23. A firearm as set forth in claim 21 wherein each of the slots is angled forwardly taken in a direction from the chamber to the top surface of the shroud.

24. In a combination, a firearm having a frame and a barrel extending from the frame, and a compensated barrel shroud that encloses the firearm barrel, a means for securing the shroud to the barrel with a portion of the shroud extending beyond the end of the barrel to at least in part define an expansion chamber, said shroud extending portion having slot means positioned substantially transversely to an axis of the barrel so that expanding propellant gas from said expansion chamber can pas through said slot means to provide downward thrust to the shroud.

25. The combination of claim 24 wherein said shroud slot means comprises a plurality of slots exposed along a top portion of the shroud.

26. The combination of claim 25 including an end cap positioned at a forwardmost outer end of the shroud and having an outlet hole coaxial with the barrel and having a diameter substantially equal to the inner diameter of the barrel, said end cap further defining said expansion chamber.

* * * * *